US010808417B2

(12) United States Patent
Gooden

(10) Patent No.: US 10,808,417 B2
(45) Date of Patent: Oct. 20, 2020

(54) PORTABLE TYPE FENCING SYSTEM

(71) Applicant: Michael John Gooden, Hamilton (AU)

(72) Inventor: Michael John Gooden, Hamilton (AU)

( * ) Notice: Subject to any disclaimer, the term of this patent is extended or adjusted under 35 U.S.C. 154(b) by 315 days.

(21) Appl. No.: 15/800,137

(22) Filed: Nov. 1, 2017

(65) Prior Publication Data

US 2019/0024405 A1 Jan. 24, 2019

Related U.S. Application Data

(63) Continuation-in-part of application No. 29/610,954, filed on Jul. 18, 2017, now Pat. No. Des. 867,118.

(51) Int. Cl.
*E04H 17/14* (2006.01)

(52) U.S. Cl.
CPC ..... *E04H 17/1421* (2013.01); *E04H 17/1443* (2013.01); *E04H 2017/1465* (2013.01)

(58) Field of Classification Search
CPC ..... E04B 1/38; E04B 1/40; E04B 1/54; E04F 2011/1819; E04F 2011/1821; E04H 17/1417; E04H 17/1421; E04H 17/1439; E04H 17/1443; E04H 17/18; E04H 2017/1447; E04H 2017/1452; E04H 2017/1465; E04H 2017/1469; E04H 2017/1478; F16B 7/044; F16B 7/0446; F16B 7/0473; Y10T 24/10; Y10T 24/26; Y10T 24/44; Y10T 24/44017; Y10T 24/44256; Y10T 24/44573; Y10T 24/50
USPC ..... 256/22, 31, 64, 65.02, 65.03, 65.08, 256/65.11, 65.12, 65.13, 70; D8/349, D8/354, 377, 382, 384, 385, 388, 394, D8/395, 499
See application file for complete search history.

(56) References Cited

U.S. PATENT DOCUMENTS

| | | | | |
|---|---|---|---|---|
| 1,322,801 | A * | 11/1919 | Lewis | F16B 7/0446 403/190 |
| 4,572,694 | A * | 2/1986 | Hoeksema | F16B 7/0473 403/187 |
| D283,006 | S | 3/1986 | Carter, Jr. et al. | |
| D287,460 | S | 12/1986 | MacKarvich | |
| 4,915,535 | A * | 4/1990 | Willetts | F16B 7/0446 403/191 |
| 4,986,513 | A | 1/1991 | Schultz et al. | |
| D379,609 | S | 6/1997 | Nease, III | |
| D408,713 | S | 4/1999 | Johnson | |
| D450,561 | S | 11/2001 | Moore et al. | |
| D451,006 | S | 11/2001 | Platt | |

(Continued)

FOREIGN PATENT DOCUMENTS

| | | | |
|---|---|---|---|
| AU | 2016101046 | 8/2016 | |
| DE | 1684577 A1 * | 12/1969 | E04B 1/5843 |

(Continued)

*Primary Examiner* — Josh Skroupa
(74) *Attorney, Agent, or Firm* — Sand, Sebolt & Wernow Co., LPA

(57) ABSTRACT

A portable or temporary fence including one or more substantially horizontal rails. A joiner is adapted to attach the rail to each post or adjacent panel, the joiner having a configuration that engages with a vertical component passing through the rail and the joiner thus effectively locking the joiner into the rail. The joiner further includes a mechanism to prevent the vertical component from moving vertically out of the joiner thus securing the panel components together.

18 Claims, 3 Drawing Sheets

(56) References Cited

U.S. PATENT DOCUMENTS

| | | | | |
|---|---|---|---|---|
| D456,701 | S | 5/2002 | Platt | |
| D481,932 | S | 11/2003 | Bess | |
| D553,954 | S | 10/2007 | Emblin | |
| D583,225 | S | 12/2008 | McNeill | |
| 8,033,530 | B2 * | 10/2011 | Timothy | E04F 11/181 256/22 |
| D654,349 | S | 2/2012 | Schopf | |
| D691,460 | S | 10/2013 | Stanic et al. | |
| D707,545 | S | 6/2014 | Schopf | |
| D722,490 | S | 2/2015 | Lyons et al. | |
| D722,493 | S | 2/2015 | Ramsauer | |
| D735,558 | S | 8/2015 | Kopp | |
| 9,366,055 | B1 * | 6/2016 | Wright | E04H 17/00 |
| D783,385 | S | 4/2017 | Zhu | |
| D810,545 | S | 2/2018 | Stevens et al. | |
| D840,217 | S | 2/2019 | Veilleux | |
| 2009/0173926 | A1 * | 7/2009 | Timothy | E04F 11/181 256/65.02 |
| 2013/0264532 | A1 * | 10/2013 | Goodman | E04H 17/1439 256/65.08 |

FOREIGN PATENT DOCUMENTS

| | | | | |
|---|---|---|---|---|
| DE | 2018648 | A1 * | 8/1971 | F16B 2/241 |
| DE | 2461474 | A1 * | 8/1975 | F16B 7/0446 |
| FR | 2352200 | A1 * | 12/1977 | F16B 7/0446 |
| GB | 2054791 | A * | 2/1981 | F16B 7/0446 |
| GB | 2170050 | A * | 7/1986 | F16B 7/044 |
| GB | 2411447 | A * | 8/2005 | A47K 10/10 |
| NL | 9300308 | A * | 9/1994 | E04G 7/22 |

* cited by examiner

PORTABLE TYPE FENCING SYSTEM

FIELD OF THE INVENTION

The field of the present invention relates generally to a temporary event fencing system of the picket or panel type. More particularly, the present invention relates to the joining of a temporary event fencing system of the rail type having one or more generally horizontal rails interconnected with a plurality of either generally upright fence posts or panels with self-supporting legs, through the use of a joiner that also secures the panel components together without the use of tools, loose pins, or fasteners.

BACKGROUND TO THE INVENTION

The use of fencing systems to enclose an area or separate one area from another has been well known for a very long time. Fences have also been commonly utilized to separate property boundaries, prevent entry into a particular area and keep people within an area. Relatively recently, there has been in an increase in the use of temporary fencing, such as that being used in construction areas or events that whilst not needing to be of a solid construction nevertheless needs to be sturdy and not easily disassembled once installed.

One of the more common types of temporary event fencing is a post type fence that comprises a series of generally vertical or upstanding posts mounted on bases that stand on the ground. Disposed between the posts are various configurations such, typically one or more generally horizontally disposed rails interconnecting each pair of adjacent posts. The rails are attached to the posts typically by the use of brackets or pins. Disposed between the rails may be numerous structures such as pickets, continuous mesh, or panels.

Another type is where there are self-standing panels that are joined to each other.

The present invention is generally directed to fences of the type that have rails with vertical boards or pickets or the panel type variety.

Whilst the above existing fencing designs provide a sturdy structure some take time to assemble and disassemble due to their intricate or small components which is obviously costly for the user, and others allow the panels or rails to be accidently or maliciously disconnected by simply lifting in a vertical plane.

The applicant has in AU patent 2016101046 disclosed a fencing system of the type having a post supporting horizontal rails that are attached to the post through the use of a joiner inserted into the rail of a configuration where the joiner and thus the rails cannot be removed from the post by only moving in the horizontal or vertical directions.

The object of this invention improves on this arrangement by providing a system of locking such a joiner to the rail, and securing the panel components together, without the use of fasteners. However the invention can also be used for other types of joiners that are locked to the rail without the use of fasteners such as a simple hook or pin style.

SUMMARY OF THE INVENTION

In one form of the invention there is proposed a fence comprising one or more substantially upright posts and one or more rails extending there between, a joiner inserted into the end of the rails and designed to engage the post, the joiner including a pair of legs defining an aperture, the rail having a collocated hole so that a picket or board can be inserted through the rail and when the joiner is inserted into the rail, the joiner is locked in place preventing removal from the rail without tools.

In preference the joiner also includes a locking means to lock the picket from removal vertically from the joiner.

Preferably the joiner further includes rearwardly and outwardly extending wings to enable the legs to separate and engage the picket or board as it is inserted into the rail.

In a further form of the invention there is proposed a fence including a fence panel comprising one or more horizontal rails, the bottom rail including a plurality of self-supporting legs, a joiner inserted into the end of the rails and designed to engage the adjacent panel, the joiner including a pair of legs defining an aperture, the rail having a collocated hole so that a picket or board can be inserted through the rail and when the joiner is inserted into the rail, the joiner is locked in place preventing removal from the rail without tools.

In preference adjoining rails are adapted to be connected to each other a joiner for connecting rails used in a fence of the type having rails, the joiner adapted to be inserted into the end of the rails and including a pair of legs defining an aperture, the rail having a collocated hole so that a picket or board can be inserted through the rail and when the joiner is inserted into the rail, the joiner is locked in place preventing removal from the rail without tools It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF THE INVENTION

Figure 1:
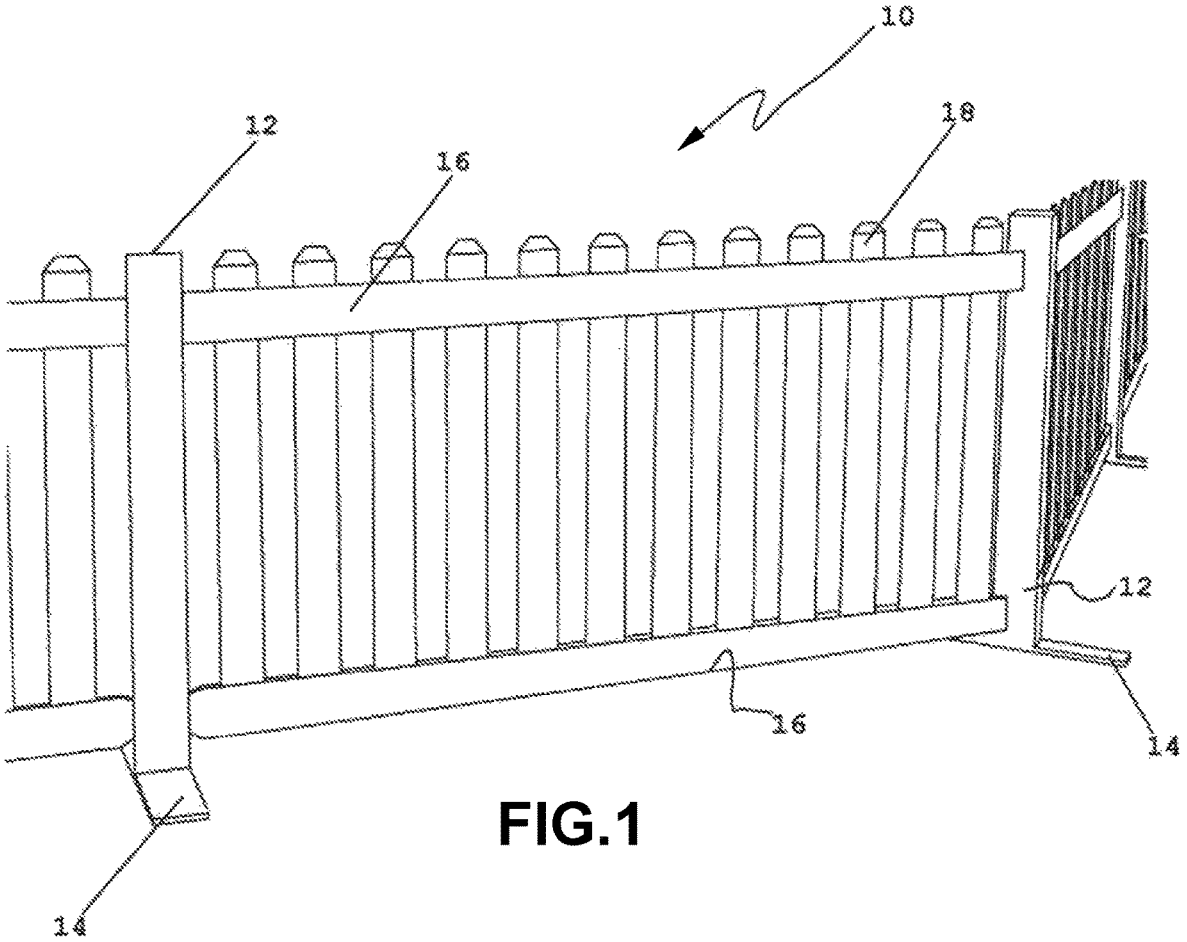
FIG. 1 illustrates a typical picket fence of the portable type.
Figure 2:
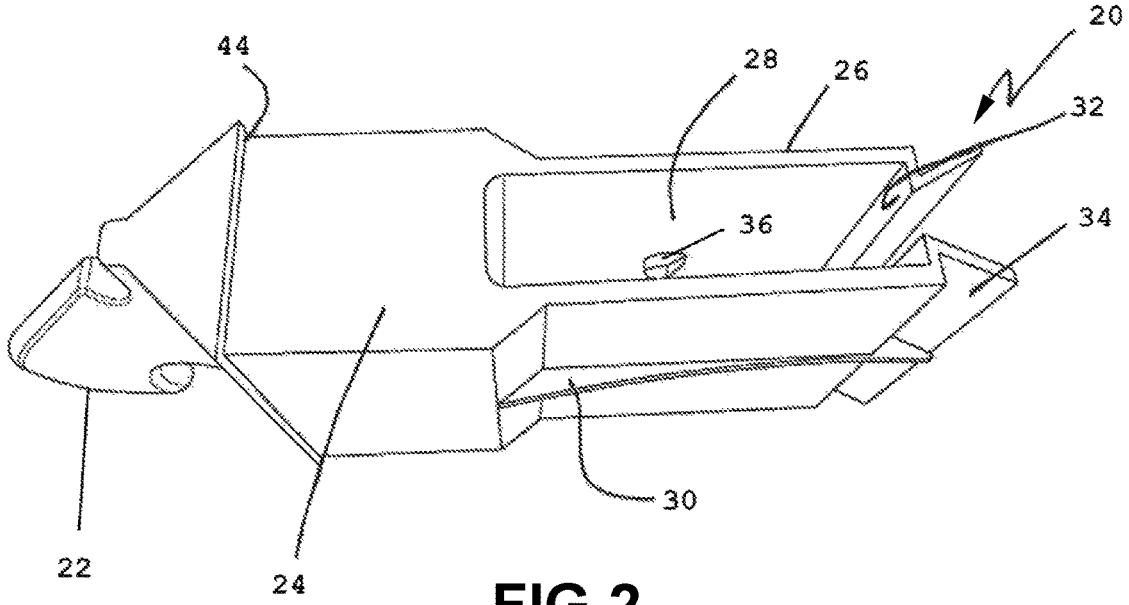
FIG. 2 is a perspective view of a joiner according to the present invention.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

The present invention provides for the joining system of a temporary fence. As illustrated in the Figures the fence 10 includes a post 12, generally of a square configuration and including feet 14 to engage the ground so as to provide stability. Horizontal beams or rails 16 extend between posts.

Typically there are two rails as illustrated although in cases where the fence may be high there may be additional rails used.

A joiner 20 acts to attach the rails 16 to the post 12. The joiner 20 is inserted into each end of the rail and engages using a hooked projection 22 a slit 42 in post 12 (there being a top and bottom slit). However the projection may be attached to the post by other known means without intending to limit it to any particular one.

The reader should appreciate that the rail when attached to the post can only be removed if the rail is raised vertically and moved horizontally at which point it may disengage from the post. At the same time the clearance afforded by the slit and the configuration of the projection 22 allows the installation of the fence over undulating ground.

The slit 42 is also slightly wider than the thickness of the projection 22 enabling the rail 16 to be rotated in the horizontal plane as illustrated in FIG. 1.

The joiner 20 includes a body 24 whose cross-sectional configuration allows it to be inserted snugly into the end of the rail. The joiner may include an abutment surface 44 that abuts against the rail to prevent the joiner from pushed fully into the rail. Extending from the body 24 are parallel legs 26 that define an aperture 28 in the joiner. The legs are braced by a reinforcing rib 30 on each leg 26. The legs define a return 32 and wings 34 that extend outwardly from the return 32. A nipple 36 extends inwardly from each leg 26.

Figure 3:
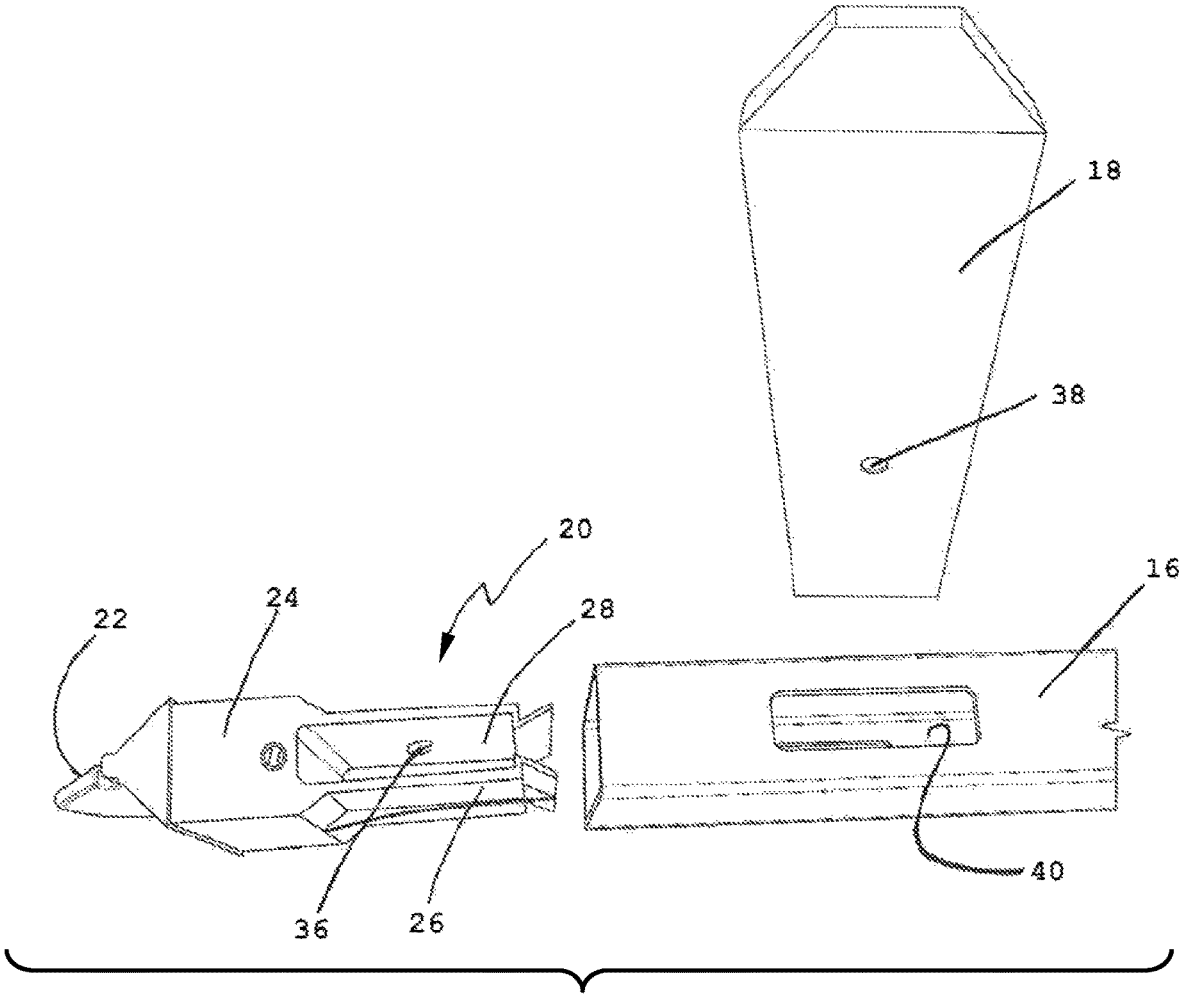
FIG. 3 illustrates the assembly of a picket, joiner and rail.
Figure 4:
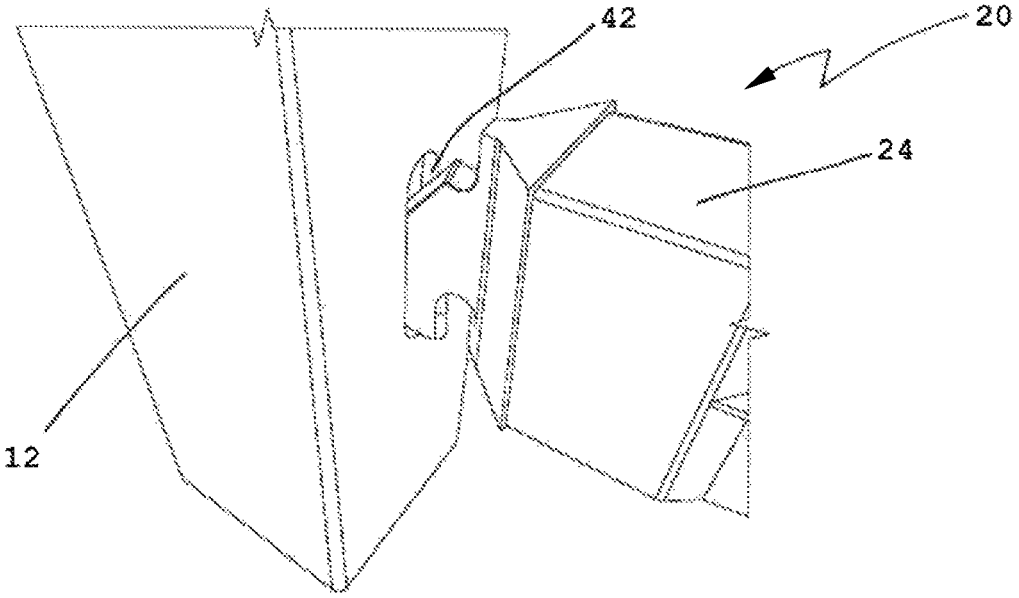
FIG. 4 illustrates the joiner before it is inserted fully into the post.

As illustrated in FIG. 3, the joiner is designed to be inserted into the end of the rail 16, the rail including an opening 40 that aligns with the aperture 28 in the joiner. A picket 18 is inserted into the rail and passes through the opening 40 and when the joiner is inserted, aperture 28 locates around the picket, thereby effectively locking the joiner from further horizontal movement so the joiner cannot be easily removed from the rail without tools. To ensure that the picket is locked "vertically" it includes a hole 38 that engages nipple 36 there being holes on either side of the picket.

Whilst the dimensions of the opening 40 are close to that of the picket, the dimensions of the aperture 28 are slightly larger to accommodate for manufacturing tolerances. The aperture may be square, rectangular, or round, to suit the picket profile.

Each picket thus passes through the top rail that typically has openings 40 both at the top and the bottom of the rail. However a rail may only have an opening on one edge, with the picket then engaging the opposite surface of the rail. To prevent the pickets that do not engage the joiner from being removed from the rails, there may be a snap fit arrangement between the picket and the bottom or even the top rail.

Whilst the above description showed as an example a fence system where rails are joined to posts it is to be understood that instead of posts, each of the fence panels may have self-supporting legs, with adjoining panels that make up the fence connected to each other.

The reader will now appreciate the present invention which provides a quick and secure method of connecting the fence panel or frame components together using a device which can also be used to join the fence panels to the posts or to an adjacent panel.

LIST OF COMPONENTS

The drawings include the following integers.

fence 10
post 12
feet 14
horizontal beam (rail) 16
picket (vertical board) 18
joiner 20
hooked projection 22
body 24
legs 26
aperture 28
reinforcing rib 30
return 32
wing 34
nipple 36
hole 38
opening 40
slit 42
abutment surface 44

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

Thus in summary the combination of the 'spring loaded' legs gripping around the back of a vertical component, and the nipple locating in a hole in the face of the component, make it impossible to pull the joiner out of the rail without spreading the legs apart, which releases the nipple from the hole and the 'clasps' around the back of the picket.

The nipple on the joiner and hole in the picket prevents the top and bottom rails from separating vertically as well.

The joiner holds the whole panel together and includes the method of joining the panel to the post or to an adjacent panel.

Thus it is to be understood that various other features may be present including but not limited to:

(a) the post may be of a rectangular or even of a circular configuration (b) the post may include multiple slits both circumferentially and vertically (c) the projection may be of different shapes (d) various ways of attaching the rail to the post or adjacent panel may be used not limited to a hooked projection (e) the aperture in the joiner may be square, round, or rectangular, to suit the vertical picket profile.

In the present specification and claims (if any), the word "comprising" and its derivatives including "comprises" and "comprise" include each of the stated integers but does not exclude the inclusion of one or more further integers.

The invention claimed is:

1. A fence comprising:

one or more substantially upright posts and one or more rails extending there between;

a joiner engaging one of the one or more rails to one of the one or more posts;

wherein the joiner includes a pair of legs defining an aperture therebetween;

an opening to the aperture defined between terminal ends of the legs of the pair of legs, wherein the pair of legs are inserted into an end of the one of the one or more rails;

wherein the one of the one or more rails has a collocated hole so that a picket or board is insertable into the hole and when the pair of legs is inserted into the one of the one or more rails, the joiner is locked in place by the picket or board preventing removal thereof from the one of the one or more rails without tools, and the joiner is unlocked by removing the picket or board.

2. The fence as in claim 1, wherein the joiner further includes a locking means to lock the picket from removal vertically from the joiner.

3. The fence as in claim 2 where the pair of legs of the joiner further includes rearwardly and outwardly extending wings to enable the legs to separate and engage the picket or board as it is inserted into the rail.

4. The fence as in claim 1, wherein the one or more rails comprises at least two rails, and wherein adjoining rails of the at least two rails are connected to each other.

5. The fence as defined in claim 1, wherein the joiner further includes a projection that extends in an opposite direction from the pair of legs; said projection being configured to engage the one of the one or more posts.

6. The fence as defined in claim 1, wherein the pair of legs of the joiner are parallel to each other and are spring loaded.

7. A fence including:

a fence panel comprising:

a plurality of horizontal rails;

wherein the plurality of horizontal rails includes a bottom rail, and the bottom rail includes a plurality of self-supporting legs;

a joiner inserted partially into an end of one rail of the plurality of horizontal rails, said joiner being configured to engage the fence panel, the joiner including a pair of spring-loaded legs defining an aperture therebetween;

a collocated hole defined in the one rail, wherein a picket or board is insertable through the hole defined in the one rail and when the joiner is inserted into the end of the one rail, the picket or board is received in the aperture of the joiner, and the joiner is locked in place preventing removal from the rail without tools.

8. The fence as in claim 7, wherein the one or more rails comprises at least two rails, and wherein adjoining rails of the at least two rails are connected to each other.

9. The fence as defined in claim 1, wherein the joiner further includes a hooked projection, and the post includes a slot defined therein, and wherein the hooked projection is received into the slot defined in the post and secures the joiner to the post.

10. The fence as defined in claim 1, wherein the joiner temporarily secures the post to the one rail, said joiner being disengageable from the post and the one rail by removing the post.

11. A joiner for connecting a first member to a second member wherein the joiner comprises:

a body;

a first leg and a second leg, wherein each of the first and second legs includes a first section and a wing, wherein the first sections extend outwardly in a first direction from a first end of the body and the first sections are oriented parallel to one another; wherein each wing extends outwardly from the associated first section of the first and second legs and is oriented at an angle to the associated first section such that the wings flare outwardly away from each other moving in the first direction away from the first end of the body;

an aperture defined between the first sections of the first and second legs;

an opening to the aperture defined between the wings;

wherein the first and second legs are capable of flexing relative to each other; and wherein the first and second legs are adapted to engage the first member; and a projection extending outwardly in a second direction from a second end of the body; said projection being adapted to engage the second member.

12. The joiner as defined in claim 11, further comprising a nipple provided on the first section of one of the first leg and the second leg; wherein the nipple extends into the aperture.

13. The joiner as defined in claim 11, further comprising a reinforcing rib extending between the body and each of the first leg and the second leg.

14. The joiner as defined in claim 13, wherein the reinforcing rib extends between the body and an outer surface of the associated first section of the one of the first leg and the second leg.

15. The joiner as defined in claim 11, wherein the projection is a hooked projection.

16. The joiner as defined in claim 11, wherein the projection is shaped as an arrowhead and tapers to a tip located remote from the second end of the body.

17. The joiner as defined in claim 11, wherein the body has an upper surface that is adapted to be oriented horizontally when the joiner engages the first member; and wherein the projection is oriented vertically relative to the upper surface of the body.

18. The joiner as defined in claim 11, wherein the first member is a fence rail having a collocated hole for receiving a picket or board therethrough; and wherein the aperture defined in the joiner is adapted to be complementary to a cross-sectional shape of the picket or board that is received in the collocated hole.

* * * * *